US007217174B1

(12) United States Patent
Medeiros

(10) Patent No.: US 7,217,174 B1
(45) Date of Patent: May 15, 2007

(54) PORTABLE OPTICAL FIBER POLISHER

(75) Inventor: Anthony Medeiros, Plant City, FL (US)

(73) Assignee: MF Lightwave, Inc, Plant City, FL (US)

( * ) Notice: Subject to any disclaimer, the term of this patent is extended or adjusted under 35 U.S.C. 154(b) by 0 days.

(21) Appl. No.: 11/278,981

(22) Filed: Apr. 7, 2006

(51) Int. Cl.
*B24B 7/22* (2006.01)

(52) U.S. Cl. ..... 451/41; 451/271

(58) Field of Classification Search ..... 451/271, 451/270, 41, 357, 240
See application file for complete search history.

(56) References Cited

U.S. PATENT DOCUMENTS

| | | | | |
|---|---|---|---|---|
| 2,320,376 | A * | 6/1943 | Mueller | 451/271 |
| 4,291,502 | A * | 9/1981 | Grimsby et al. | 451/271 |
| 4,979,334 | A | 12/1990 | Takashi | |
| 5,184,433 | A * | 2/1993 | Maack | 451/41 |
| 6,077,154 | A | 6/2000 | Takashi et al. | |
| 6,471,570 | B1 * | 10/2002 | Minami et al. | 451/271 |
| 6,913,528 | B2 * | 7/2005 | Schulz et al. | 451/285 |
| 2003/0040263 | A1 * | 2/2003 | Minami | 451/42 |

FOREIGN PATENT DOCUMENTS

| | | | | |
|---|---|---|---|---|
| JP | 59-110540 | * | 6/1984 | 451/240 |
| JP | 62-199346 | * | 9/1987 | 451/439 |
| JP | 3-234457 | * | 10/1991 | 451/387 |

* cited by examiner

*Primary Examiner*—Robert A. Rose

(57) ABSTRACT

A polisher has an offset axis and a friction cam useful in a method of polishing that comprises a more random, elongated polishing pattern than known orbital polishers and is capable of portable use using a 9 volt battery. The method is capable of using lower contact pressures between fiber ends and a polishing surface and higher rates of rotation of the drive mechanism, reducing the polishing time for preparing fiber ends for applications. The polishing pattern changes when pressure is applied between a fiber end and the polishing surface. The fiber end provides one intermittent axis of rotation and the friction cam provides another intermittent axis of rotation.

19 Claims, 5 Drawing Sheets

PORTABLE OPTICAL FIBER POLISHER

FIELD OF THE INVENTION

The field relates to a polisher for polishing an optical fiber connector end.

BACKGROUND

Today's high speed optical network systems use optical fiber connectors to connect optical fiber ends together. These connectors have highly polished endfaces that are required to meet certain industry standards for performance and intermateability. One standard, Telcordia GR326-CORE issue 3, states that optical fiber connectors must meet defined specifications for the following three parameters of endface geometry: radius of curvature, fiber undercut, and apex offset. Consistent endface geometry creates an optimal core-to-core alignment during the mating process of two connectors.

Orbital polishers are known that repeat a spiral pattern around a central drive axis, such as the pattern shown in FIG. 4. FIG. 4 shows orbital rotation about a rotational axis A of the polishing disk, which is also referred to herein as a polishing wheel, plate and/or platen, together with rotation about another drive axis B that creates a circular-spiral pattern between the polishing surface and a fiber end held in contact with the polishing surface of the orbital polisher. A polishing disk may refer to a replaceable single unit or may be comprised of a plurality of components, such as a durable platen and a disposable disk having a polishing surface. Orbital polishers are known to create wear of the polishing surface along circular paths. Thus, polishing disks must often be replaced due to wear or build-up of foreign particles locally in a high-wear area on the disk. Also, the orbital pattern of such polishers is not as efficient as the pattern that may be applied by a highly skilled human polishing a fiber end by hand. Also, series of polishing media and pressures are used to achieve polished fiber ends that meet industry standards, but this process either requires multiple polishing disks or time consuming replacement of polishing surfaces between one polishing medium and the next in the series. These shortcomings increase costs and reduce portability of polishing stations. For example, U.S. Pat. No. 4,979,334 discloses an orbital polishing apparatus having a polishing disc rotating about its own axis with the entire disc rotating about another drive axis.

State of the art polishing methods require multiple steps, such as five separate steps, requiring five minutes of polishing to meet industry standards for optical fiber end face geometry. For example, polishing may require epoxy removal (30 seconds), radius forming (90 seconds), rough polishing (60 seconds), final polishing (60 seconds), and finishing polishing (60 seconds), this is an inefficient and impractical process when applied in the field and outside of a controlled plant environment.

Optical fiber polishers using the current optical fiber polishing technology have the additional problem of having to apply varying amounts of pressure between the connector end and the polishing surface for each of the five polishing steps. These pressures are complex to set up and to maintain throughout the polishing process. Applying too much or too little pressure during a polishing step may adversely affect the quality of the polished connector end surface. For example, U.S. Pat. No. 6,077,154 discloses an optical fiber polishing apparatus that reduces burdens on operators for adjusting polishing pressure between steps of polishing, but fails to eliminate the need for adjusting polishing pressure between polishing steps.

While previous inventions provided orbital patterns and improved adjustability of the apparatus, an improved polishing pattern that provides for an apparatus capable of a one-step process for fiber end polishing would be a compelling improvement over the state of the art orbital polishers. If such a polisher were portable and capable of long use on a single charge of a battery, then it would be more readily adapted for use in the field than systems requiring mounting in a van and comparatively high power consumption.

SUMMARY OF INVENTION

A polishing system for polishing a fiber end comprises a central axis of rotation about a motorized drive axis of the polishing system and a polishing disk having three additional rotational axis. The first axis of rotation of the polishing disk is offset from the central axis of rotation by a preset distance. The second axis of rotation is provided only when the fiber end is in contact with the surface of the polishing disk. At a contact point between the fiber end and the polishing disk, a rotational axis is provided. The third axis of rotation is provided intermittently at a contact point between a friction cam and a surface of a structure attached to a base of the polishing system. The system provides a unique polishing pattern that is an improvement over all known polishers, such as conventional orbital polishers. The system uses a friction cam offset from the first axis of rotation of the polishing wheel. The friction cam is capable of making contact with the fixed surface of the structure attached to the base. When contact occurs, the polishing disk is capable of rotating about the point of contact between the friction cam and the fixed surface. Contact between the friction cam and the fixed surface is intermittent; therefore, rotation about the second axis and the third axis is intermittent.

A polisher is capable of use in the field as a portable unit, which has a unique polishing pattern that is capable of polishing optical fiber connecter ends using a single processing step rather than multiple steps, while still meeting industry standards for optical fiber end polishing. The polisher is also capable of correcting defective connector ends that were previously polished using other methods of polishing.

One advantage is that a polisher may have a pattern that reduces the rate of wear on the polishing surface. The motion generated is a non-orbital and non-circular motion, when pressure is applied between a fiber end and the polishing surface. Although not completely random, the pattern is more random and is more similar to a pattern used by a trained technician. One advantage of the pressure-induced pattern is that the pattern is capable of covering a larger surface area of the polishing surface. Another advantage is that no skill is required. A holding assembly may be used that holds an optical fiber end on the polishing surface without adjusting the pressure, while meeting or exceeding industry standards for fiber end quality.

No known device is capable of creating the pattern produced by a polisher of the present invention that uses a cam extending from the surface of the polishing disk that is opposite from the polishing surface. Yet another advantage is that a simple drive unit with only a single drive axis is capable of generating the non-circular and non-orbital pattern. This allows the polisher to be compact and portable. Also, the simple design reduces power consumption. The pattern also allows much more rapid polishing, increasing the number of optical fiber ends that may be polished on a single charge of a battery.

The non-orbital and non-circular pattern that is created by relative displacement between an optical fiber end and the polishing surface is generated, when the fiber end is pressed against the polishing surface. The fiber end acts as a rotational fulcrum that causes the polishing disk to rotate about its central axis, which is offset from the central axis of the drive. The offset causes the polishing surface in contact with fiber end to slide away from the fiber end. A cam extending from a surface of the polishing disk is capable of reorienting the direction of movement of the polishing surface with respect to the fiber end, when the cam makes contact with a surface extending under the polishing disk from the polishing base. Thus, a simple, yet elegant, mechanism is provided that generates a pressure-induced, reduced-wear, and rapid polishing pattern that requires no pressure adjustment and is capable of meeting industry standards with a single polishing medium.

Application of pressure on the polishing surface, while the polishing disk is rotatably offset-mounted to a rotating central drive axis, causes rotation of the polishing disk. A combination of rotation and orbital motion of the polishing disk eventually brings the cam, such as a friction bumper or wheel, into contact with a surface extending from the base. A friction bumper or wheel may be made of a resilient, wear-resistant material, such as a rubber material or a metal post covered with such a material or a post that serves as an axle for a small wheel or an O-ring stretch fit onto a post. The post may have a seat machined or formed in the post, which resembles a groove around the post, to help retain an o-ring. In one example, at the moment of contact between a friction cam and the surface, the polishing disk still has rotational freedom about the central axis of the disk, rotational freedom about the cam, and rotational freedom and translational degrees of freedom in two dimensions, subject to frictional losses, between the fiber end and the polishing surface, resulting in a momentary reorientation of the polishing disk. This momentary reorientation of the polishing disk is capable of generating a very favorable polishing pattern that uses much of the polishing surface to polish fiber ends and is not reproduced by any other polishing apparatus.

Another advantage is that a polisher is capable of polishing an optical fiber connector end in less steps and in substantially less time. When polishing optical fiber connector ends to meet industry standards for end face geometry, a polisher according to one embodiment of the invention is capable of using only two steps that take an aggregate amount of time of only about one minute, compared to many more steps and nearly five minutes, in aggregate, for state of the art devices. In one method using such a polisher, a first step takes about 45 seconds and combine the steps of epoxy removal, rough polishing, and radius forming. A second step, taking about 15 seconds, completes final polishing and finishing steps capable of meeting industry standards for end faces.

Another advantage is polishing without adjusting the amount of pressure needed for separate steps of the polishing process. For example, in the previous method, a fiber holding assembly of the polisher may be set up for the first step to apply a certain amount of pressure between the connector end and the polishing surface. The amount of pressure to be applied for the second step may be kept the same and does not have to vary from the first step. This capability simplifies the polishing process.

An optical fiber polisher may have an additional advantage of being portable. The polisher is capable of being light, being picked up by hand and being easily transported. It is also capable of operating on a DC power source, such as a battery.

BRIEF DESCRIPTION OF THE DRAWINGS

The drawings illustrate examples of the present invention.

DETAILED DESCRIPTION

Some examples of the invention will now be described using the drawings. While the examples are necessary to meet the written description, best mode and enablement requirements of the laws and rules for patent applications, these examples should not be considered as limiting the claims. Instead, the claims should be limited only by the language of the claims, themselves, as issued, as they would be interpreted by a person familiar with the field.

Figure 1:
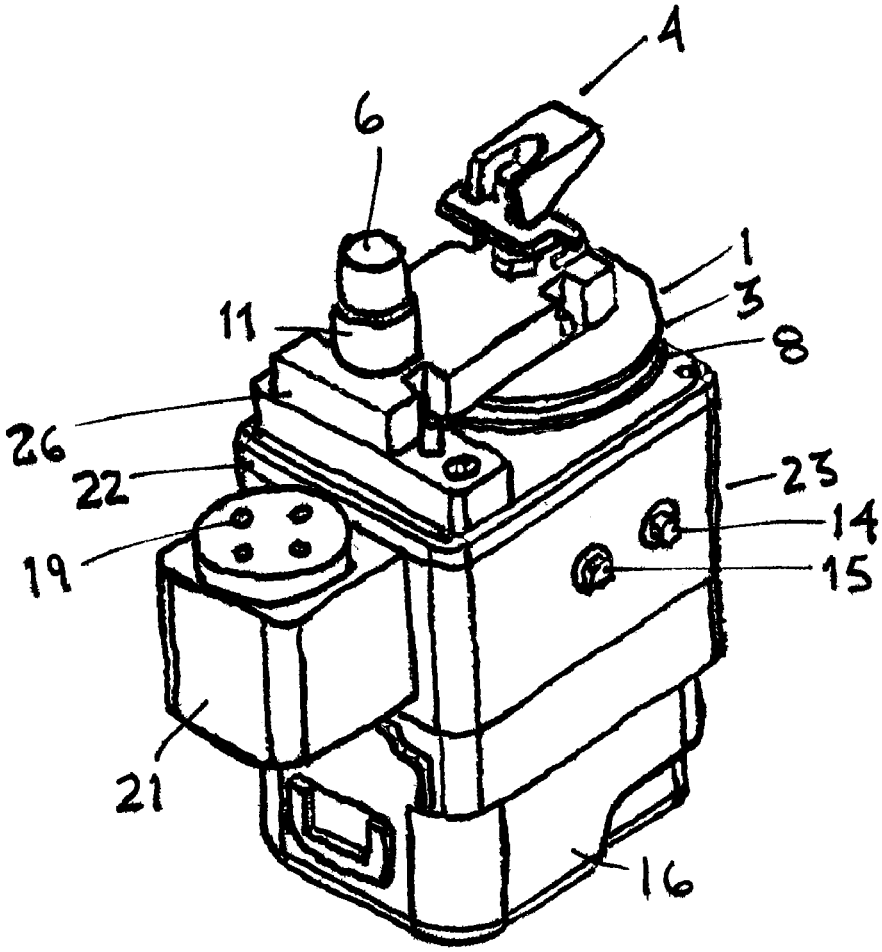
FIG. 1 is a perspective view of an example of an assembled polisher.
Figure 2:
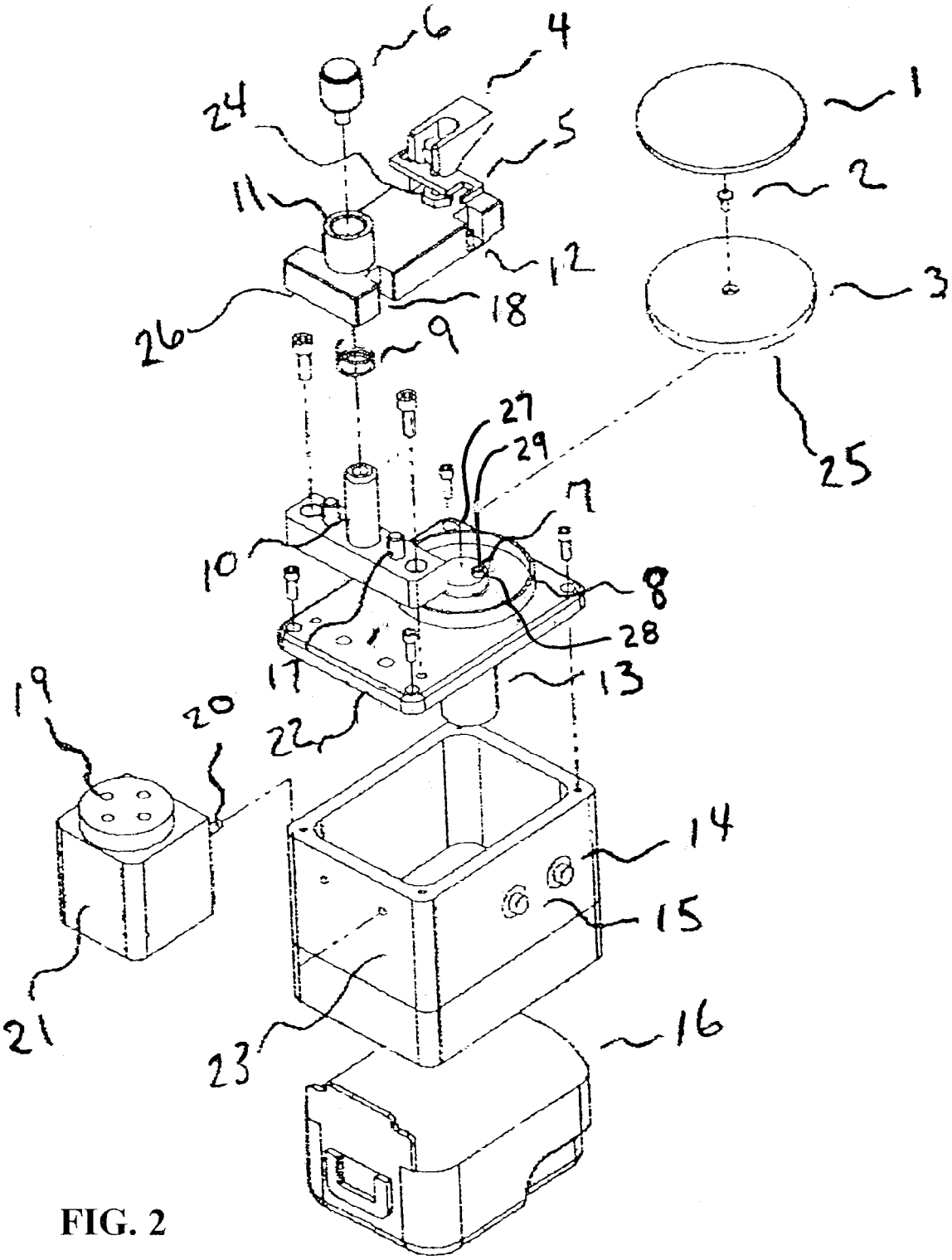
FIG. 2 is an exploded view of the example of FIG. 1.
Figure 3:
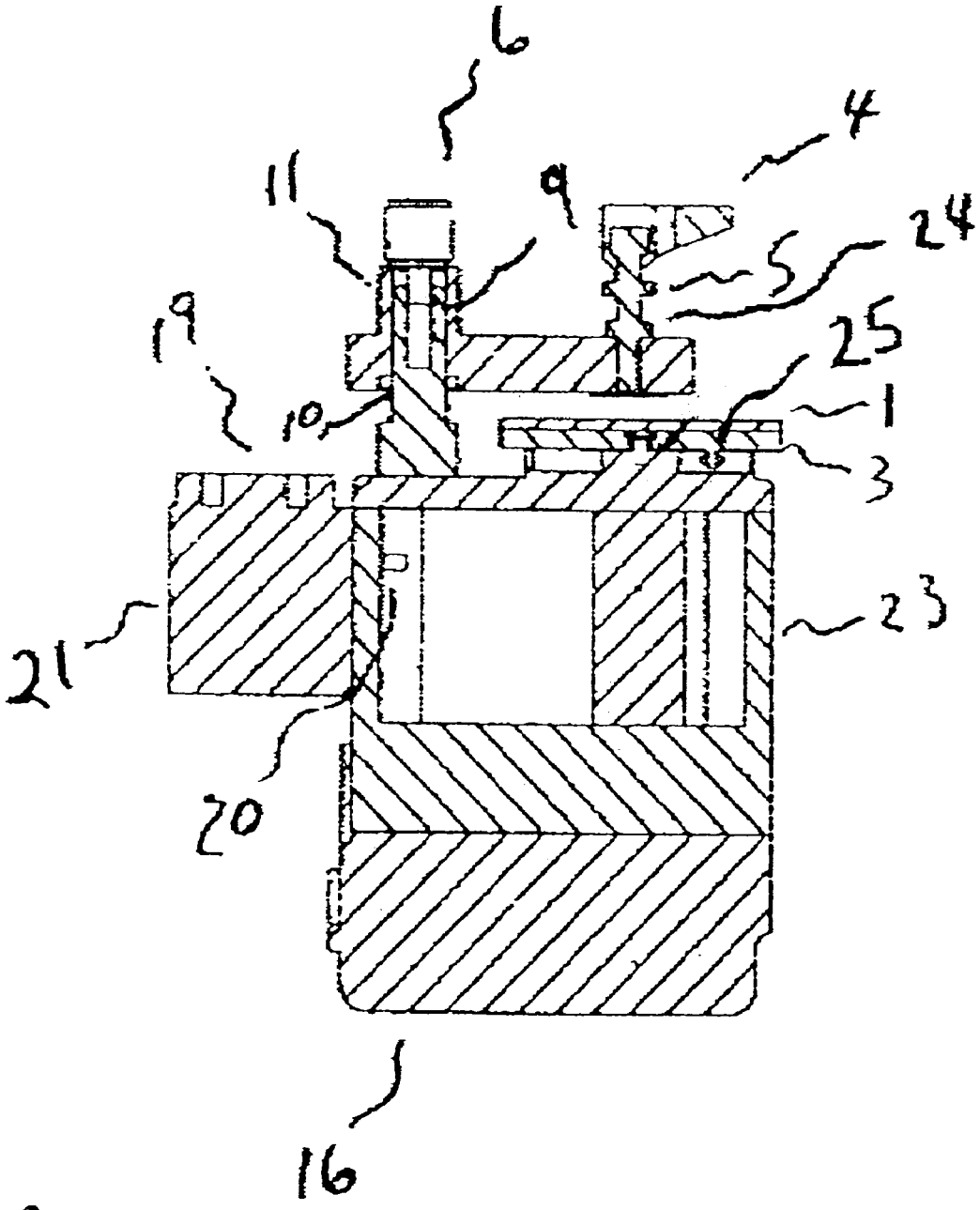
FIG. 3 is a sectional view of one side of the example illustrated in FIG. 1.

Now referring to FIGS. 1 to 3, a holding assembly 26 is mounted to the base of the polisher 23, which is capable of holding an optical fiber end using holder 4. The holding assembly 26 is capable of adjusting pressure between the fiber end and a polishing surface 1. A connector may be inserted into the connector ferrule holder 12 of the holding assembly 26 for polishing. A biasing mechanism, such as a spring 9, may be used to prevent contact between the fiber end and the polishing surface 1, until button 6 is pressed. The pressure between the fiber end and the polishing surface 1 is adjustable using the adjusting mechanism 5. A rotary cam 7 and a wall 8 extend from the top surface of the base 23.

A polishing disk comprises a plate 3 supporting the polishing surface 1 and an attachment device for rotatably mounting the plate 3 at an offset axis 29 to the central drive axis 27 of the drive motor 13. For example, the attachment device is a pin 2 or may be a bolt, screw, rivet or any other device capable of attaching the plate 3 to the base 23 while allowing the plate 3 to rotate freely. A polishing surface 1 may use a diamond polishing medium, a diamond film, or any other of the well known polishing materials. The polishing surface 1 shown in the example is mounted on a resilient rubber polishing pad, which is well known in the art and need not be shown in detail in the drawings. Any other polishing medium may be used that is capable of achieving industry standards of fiber end quality.

When the polishing disk 3 is coupled to drive motor 13 at an offset axis 29 at or near an outer diameter 28 of the drive motor, then the polishing surface 1 may orbit the central drive axis 27 of the drive motor 13 and may rotate about the offset axis 29. Rotation about the offset axis 29 occurs when pressure is applied between the fiber end and the polishing surface 1.

Figure 5:
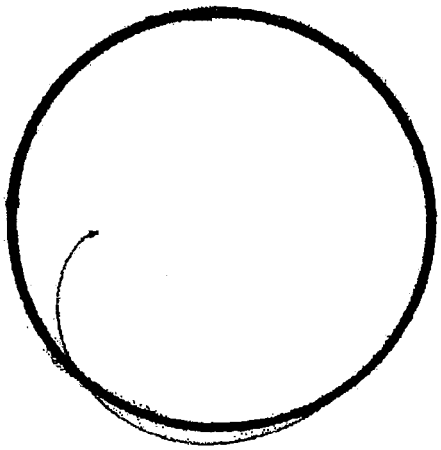
FIG. 5 is an example of the pattern produced without pressure applied.

FIG. 5 shows a circular pattern produced when no (or very little) pressure is applied between a pen (i.e. at the location of fiber contact) and the polishing surface.

Figure 4:
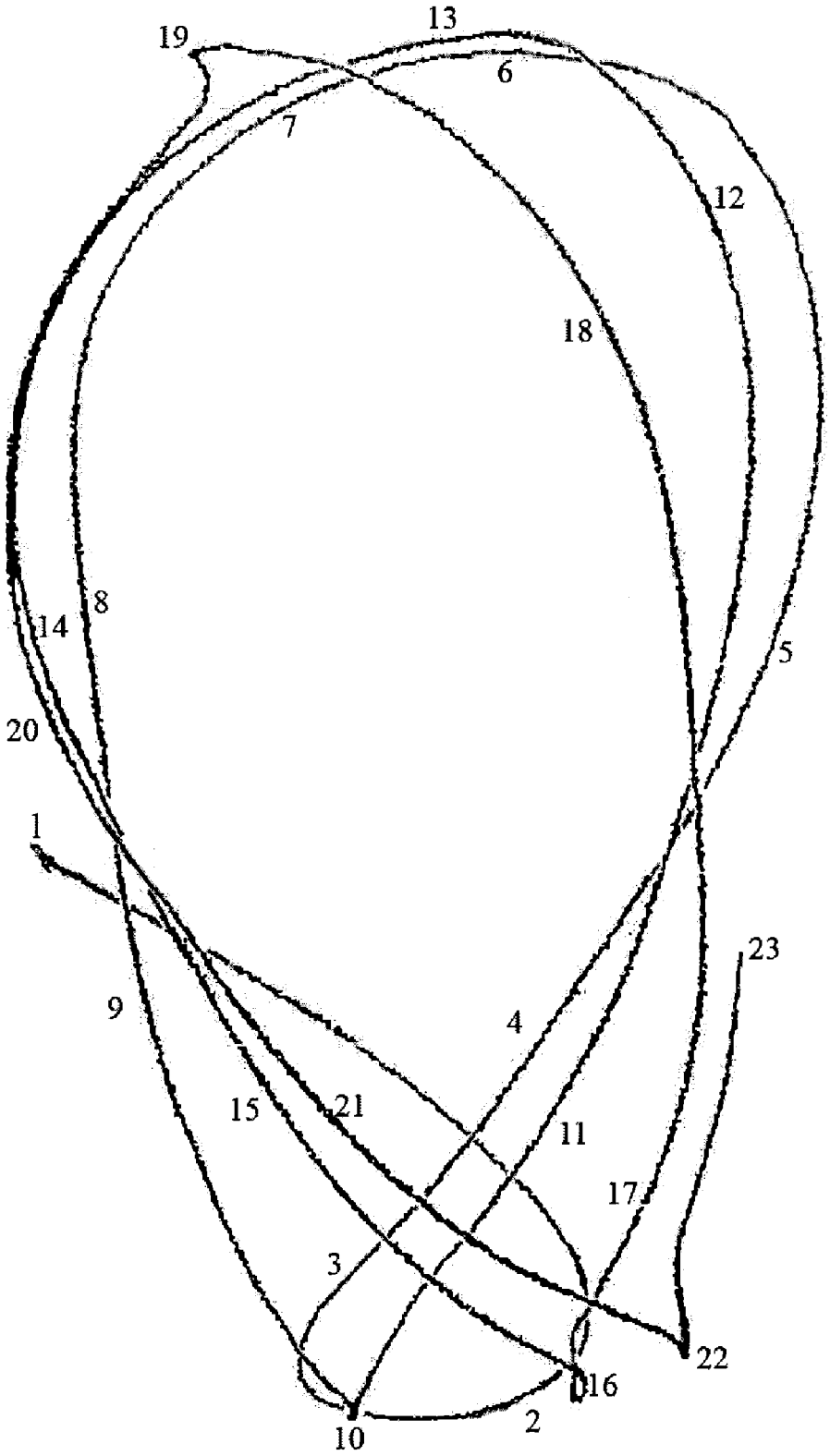
FIG. 4 is an example of a few revolutions of a pressure-induced pattern.

FIG. 4 shows a few revolutions of the polishing disk of the polisher when pressure is applied between a pen and the polishing surface. Different points along the polishing pattern are shown by numbers from 1 to 23, which do not correspond in any way with numbers shown in FIGS. 1–3. At 1, the pen made contact with the surface and pressure was applied between the pen and the polishing surface of the polishing disk. Initially, the pen traced a pattern to the right; however, the direction begins to reverse itself as the pen proceeds to 2. Following the trace to 3 shows a reversal in direction toward the upper right past 5, until looping along the trace from 6–9 in a counter clockwise direction. The trace at 10 shows that polishing surface rotates around the pen (i.e. representing the second axis of rotation about the contact point between the fiber end and the polishing disk) before proceeding counter clockwise along the trace from 11–15 in another loop. At 16 a second rotation about the pen that creates a figure eight before proceeding in another loop from 17–21. At 22 a third rotation about the second axis of rotation occurs, redirecting the polishing path along another loop toward 23, when the pen was removed from contact with the surface.

Now referring to the FIGS. 1–3, the unique polishing pattern shown in FIG. 4 may be explained. The friction cam 25 extending from the bottom of the polishing disk 3 is capable of making contact with the inner surface of the wall 8, the wall 8 extending upwards from the top 22 of the base 23. When the friction wheel 25 makes contact with the wall 8 the direction of movement of the friction wheel 25 is restrained, causing rotation about an axis of rotation located at the point of contact between the wall 8 and the friction wheel 25 (i.e. the third axis of rotation of the polishing disk). Rotation about the axis of rotation of the polishing disk 3 (i.e. the first axis of rotation of the polishing disk) occurs as soon as pressure is applied between the pen and the surface of the disk. The pen, which is sitting in for a fiber end, provides drag on the surface of the disk, causing an initial reorientation of the polishing pattern. Subsequently, intermittent rotation about the second axis of rotation (pen contact point) and the third axis of rotation (friction wheel 25 contact point) cause directional changes in the pattern that extend the pattern of contact between the pen and the polishing surface from one side of the polishing disk to the next.

Figure 6:
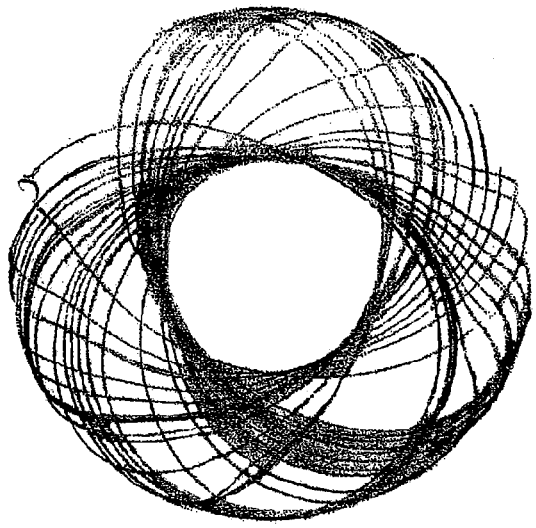
FIG. 6 is a pressure-induced pattern with about 50 revolutions.
Figure 7:
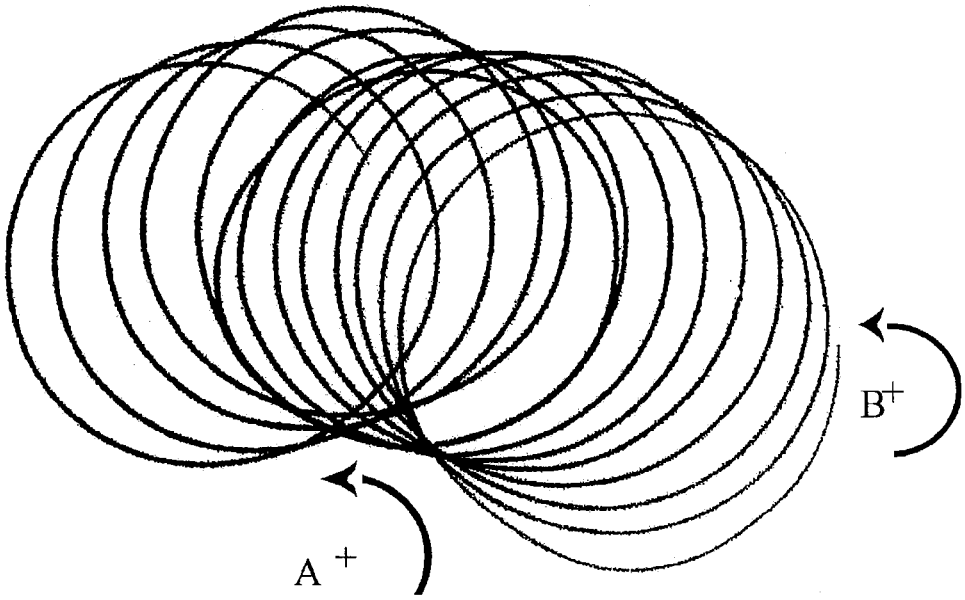
FIG. 7 (PRIOR ART)
FIG. 7 is an orbital pattern of a prior art device.

FIG. 6 illustrates another trace, except in FIG. 6 the pen remained in contact with the polishing surface for 50 revolutions. FIGS. 4–6 may be compared with the trace made by an orbital polisher of the prior art, which is shown in FIG. 7. For the orbital polisher, there is no difference between the trace made with and without pressure applied. Regardless, the pen traces out a series of circular spirals around a moving offset axis B. Axis B rotates about the axis A of the polishing pad. The resulting pattern of the orbital polisher has two high density zones for wear at the outer radius and the inner radius of the circular spiral.

Fundamental differences in the mechanism in examples of the present invention provide a polishing pattern very different from any prior art orbital polisher. The drive motor 13 acts as a rotary cam 7 offset from the central axis 27 of the polisher with an attachment mechanism 2 coupling the polishing disk 3 such that it is capable of rotating freely about the offset axis, the first axis of rotation 29 of the polishing disk 3. Application of the optical fiber connector end on the polishing surface 1 causes rotation of the disk 3 and reorientation of the friction wheel 25, such that the friction wheel 25 makes physical contact with the wall 8. When the friction wheel 25 makes contact, the relative motion between the fiber end and the polishing surface 1 is altered by a comparatively rapid change in the rotation about the fiber end. Thus, the pattern is a pressure-induced, comparatively random, non-circular and non-orbital pattern that is not achievable using prior art polishers. The polishing system uses this unique polishing pattern to provide a rapid, portable polisher for use in the field; however, the polishing system may be applied to fixed, automated polishing stands, also.

In one example, a friction wheel is a small rubber bushing fitted on a post 25, such as shown in FIG. 3. Alternatively, the friction cam 25 may be a small wheel or any other type of bumper capable of making contact with a wall such that the wheel rotates about contact point between the bumper and the wall at least momentarily, providing for reorientation of the path of the fiber on the surface of the polishing surface 1.

In the example shown in FIGS. 1–3, the polishing disk 3 is coupled to the rotary cam 7 with a holding screw 2. When the holding mechanism 4, 5 applies pressure on the polishing surface 1 via a fiber end, the polishing surface 1 and polishing disk 3 are forced downward, freeing the disk 3 from the holding screw 2. Thus, the downward movement of the polishing disk 3 allows rotation of the polishing disk 3, which causes the friction wheel 25 to make physical contact with the inside of the base wall 8. Because the polishing surface 1 and the polishing disk 3 may freely rotate, the physical contact between the friction wheel 25 and the inside of the base wall 8 causes the polishing surface 1 and polishing disk 3 to momentarily stop resulting in a change in direction of the polishing motion. The change in direction of the polishing motion causes a "randomness" of the polishing motion and extends the polishing from one edge of the polishing surface 1 to an edge nearly opposite of the first edge.

In one example, a snap and slide 12 volt battery 16 is attached to the bottom of a polisher base housing 23. A heater oven block housing 21 is attached to a side of the polisher base housing 23. A heater oven block 19 is connected to the heater oven block housing 23. Heater oven block contacts 20 extend from the heater oven block housing 21, through the side of the polisher base housing 23, into the interior of the polisher base housing 23. A primary step switch 15 and a secondary step switch 14 are situated on a side of the polisher base housing 23. A base wall 8 extends from the top surface of the polisher base housing. A drive motor, gear assembly and shaft 13 are attached to the interior of the polisher base housing 23 and the distal end of the shaft protrudes through the top surface of the polisher base housing 23. A rotating cam 7 is located at the offset axis near the outer edge of shaft 13. A holding screw 2 couples the polishing surface 1 and polishing disk 3 to the rotating cam 7 at an offset position 28 on the rotating cam 7. A friction wheel 25 extends from the underside of the polishing disk 3. A holding fixture 26 is attached to the polisher base housing 23 by a hold down screw 6, a support insert 11, a support spring 9 and a support post 10. An alignment post 17 fits into an alignment slot 18 of the holding fixture 26. A cantilever latch 4, spring loaded locking mechanism 5 and latching spring 24 may hold the connector end in the connector ferrule holder 12.

In one example, an operator inserts a connector into a holding fixture 26. The end of the connector is held perpendicular to the polishing surface 1. A spring loaded locking mechanism 5 locks the connector end into the holding fixture. Next, the operator depresses a primary step switch 15 to turn on the power to the polisher. A circuit within the polisher automatically shuts off the polisher after 45 seconds have expired and disables the primary step switch 15. The primary step switch remains disabled until a secondary step completes. When the polisher is turned on, the rotating cam 7 rotates causing the polishing surface 1 and polishing disk 3 to orbit about the central axis of the polisher 27. Next, the operator rotates a cantilever latch 4 over the spring loaded locking mechanism 5 to create a downward pressure by the distal end of the connector on the polishing surface 1. The connector end makes physical contact with a polishing surface 1, the polishing surface 1 may be a disc of diamond polishing film placed over a resilient rubber pad, for example. The resulting effect is that the connector end is polished against a large area of the polishing surface 1 allowing the polishing time to obtain industry standards for radius of curvature and apex offset to be reduced to 45 seconds. Next, the operator loosens and rotates to the side the holding fixture 26 allowing replacement of the polishing surface 1. For example, the polishing surface 1 is replaced with a silicon dioxide polishing film on a resilient rubber polishing pad. Silicon dioxide media is capable of buffing the fiber surface, removing a layer from the surface having a different index of refraction than the material of the fiber under the disturbed surface layer that was created during the diamond polishing step 1. This final buffing step does not change the radius of curvature or Apex offset of the fiber endface, but does change the fiber protrusion and undercut. Thus, the final buffing step must be carefully controlled.

A method of polishing according to one embodiment of the invention uses a reduced time of polishing, which fulfills the requirements for control of the removal of the disturbed surface layer. The operator locks the holding fixture 26 back in place over the polishing surface 1. The operator rotates the cantilever latch 4 to the full locking position increasing the pressure of the connector end against the polishing surface 1. Next, the operator depresses a secondary step switch 14 to again turn on power to the polisher. A circuit within the polisher automatically shuts off the polisher after 15 seconds have expired and disables the secondary step switch 14. The secondary step switch remains disabled until the primary step completes. When the polisher is turned on for the second step, the polisher functions just as it did for the first step. The resulting effect is that the connector end is polished against a large area of the polishing surface 1 allowing the polishing time to obtain industry standards for fiber undercut to be reduced to 15 seconds in one example.

In another example, a single polishing step provides for a fiber end that meets industry standards using a 1 micron diamond polishing medium to polish a fiber end from start to finish with a single polishing step. In another example, a 12 volt heater 19, 20, 21 may be added to the polisher to cure epoxy filled connectors.

A method of polishing an end of an optical fiber for use in fiber optical systems may include mounting a polishing disk having a polishing surface on a polisher of the present invention, applying a polishing substance on the surface of the polishing disk, inserting the optical fiber in a holding assembly, applying a predefined pressure between the end of the optical fiber and the polishing disk, and actuating a drive connected to the polishing disk at a selected rate of rotation. Polishing may proceed in single step without replacing the disk or changing the pressure setting of the step of applying a predefined pressure and is capable of removing any epoxy on the end of the optical fiber, rough polishing the end of the optical fiber, and final polishing the end of the optical fiber. The rate of rotation and the predefined pressure during the step of polishing are selected, such that the step of polishing is completed in about 45 seconds or less than 45 seconds.

Preferably, an optical fiber is selected having a fiber end radius and apex offset nominally operative for a desired application, such that no step of radiusing of the fiber end is needed. Then, the step of applying a predefined pressure selects a pressure such that the fiber end radius and apex offset do not substantially change during the step of polishing. Thus, no step of buffing will be needed after the step of polishing and prior to use in the desired application. The single step of polishing the end prepares the fiber for use in the desired application without further operation of the polisher.

For example, the step of applying a predefined pressure selects a pressure of about 0.4 pounds or less than 0.4 pounds. A pressure of about 0.4 pounds may be used for an optical fiber of a glass or ceramic material, when a 1 micron diamond film is selected as the polishing film on the polishing disk. In this example, the rate of rotation during the step of polishing is selected and the predefined pressure is selected, such that the step of polishing is completed in less than one minute. Preferably the polishing step takes about 45 seconds or less than 45 seconds. About 45 seconds is used to define a period that allows for normal tolerances in control of an automated polishing process. The rate of rotation of the drive of one a polisher according to an example of the present invention, and other parameters needed to achieve a nominally operative fiber quality, may be easily determined by trial and error for optical fibers of different types and will ordinarily require speeds substantially greater than used with known, conventional orbital polishing devices. A low pressure and high speed method of fiber end polishing is incompatible with complicated orbital polishing machines.

A step of radiusing of the end of the optical fiber may be included in the method for fibers not already radiused by the manufacturer. In this example, a radiusing step is included using a polisher such that the fiber end radius and apex offset are nominally operative for the desired application. By nominally operative it is meant that the fiber end radius and apex offset fall within the industry standard ranges for use of the fiber in the desired application. Such industry standards are readily available to a person of ordinary skill in the art and may vary from one application to the next. Nevertheless, the step of radiusing may easily be performed using any commercial polisher or using an example of the polisher of the present invention. Typically, radiusing uses a pressure greater than the pressure selected in the step of polishing, and this pressure might require the removal of a disturbed surface layer, if the step or radiusing causes the develop of such a surface layer on the end of the optical fiber.

A single step process for forming the proper endface geometry may be used in place of the current industry process, which uses a series of steps to achieve the proper industry standard for endface geometry example. Step 1: Epoxy removal 30 micron Aluminum Oxide, 0.5 lbs pressure. Step 2: Radius Forming, 6 micron diamond 2.5 lbs pressure. Step 3: Rough Polishing, 3 micron diamond 3.5 lbs pressure. Step 4: Final Polishing 1 micron diamond 3.5 lbs pressure. Step 5: Buffing, 0.05 micron Silicon Dioxide 4 lbs pressure. The single step process may accomplish four of the five steps mentioned above by utilizing a more efficient polishing pattern and increased disk speed of the polisher described in the examples of the present invention. A 1 micron diamond film in conjunction with a polishing solution that acts as a lubricant quickly resurfaces a fiber connector, for example. A pressure of about 0.4 lbs, or even less than 0.4 pounds, may be applied during Step 1 with a 1 micron diamond film. The epoxy is rapidly removed due to an increased rate of rotation selected for the drive. The optimal speed is easily determined by trial and error, which may be selected to achieve nominally operative fiber end quality in a short polishing time. Also, if a reduced pressure is used, then the connector surface is not disrupted by an altered surface layer and no further resurfacing is necessary by using a buffing step. Ordinarily, the fiber connector is pre-radiused during the connector manufacturing process to meet industry standards for radius of curvature and apex offset. The polishing process of the invention, unlike other polishing methods, is capable of limiting the amount of material that is removed from the connector ferrule thereby limiting change to the factory preset radius of curvature and apex offset. Thus, a separate radiusing step may not be necessary.

In yet another example, the holding fixture 26 may contain two or more connector ferrule holders 12 such that a plurality of connector ends may be polished at the same time.

What is claimed is:

1. A polisher for polishing an optical fiber end, the polisher comprising:

a base;

a drive motor having a central drive axis, the drive motor being supported by the base; and a polishing disk having a central axis, a polishing surface on a first surface and a cam extending from a second surface opposite of the first surface, the polishing disk being coupled with the drive motor, the central axis of the polishing disk being offset from the central drive axis, such that the polishing surface orbits about the central drive axis when no pressure is applied to the polishing surface, and the cam being capable of interacting with the base, such that, when the optical fiber end is pressed onto the polishing surface, relative motion between the polishing surface and the optical fiber end is neither circular nor orbital.

2. The polisher of claim 1, wherein the base includes a wall, and the cam is capable of making contact with the wall during relative motion between the polishing surface, affecting changes in relative motion between the polishing surface and the optical fiber end.

3. The polisher of claim 2, wherein the cam extends from the second surface at a location offset from the central axis of the polishing disk.

4. The polisher of claim 3, wherein the cam comprises a post and a friction wheel of an elastic material, the friction wheel being fixedly fitted around the post.

5. The polisher of claim 4, wherein pressure between the optical fiber end and the polishing surface causes the polishing disk to rotate about the central axis of the polishing disk, while the central axis of the polishing disk is rotating about the central drive axis.

6. The polisher of claim 1, further comprising a holding assembly mounted on the base, wherein the holding assembly is capable of holding the optical fiber end in contact with the polishing surface during polishing of the optical fiber end.

7. The polisher of claim 6, wherein the holding assembly is mounted on the base such that the holding assembly is capable of adjusting pressure between the polishing surface and the optical fiber end.

8. The polisher of claim 7, wherein the holding assembly is rotatably fixed in relation to the base.

9. The polisher of claim 1, wherein the drive motor is electric.

10. The polisher of claim 9, further comprising a battery coupled physically to the base and coupled electrically to the drive motor, such that the polisher is portable.

11. A polishing system for polishing a fiber end comprises a central axis of rotation about a motorized drive axis of the polishing system; and a polishing disk having a first axis of rotation offset from the central axis of rotation by a first distance, a second axis of rotation provided at a contact point between the fiber end and the polishing disk, and a third axis of rotation provided at a contact point between a friction cam and a surface of a structure attached to a base of the polishing system, wherein the friction cam is displaced from the first axis of rotation by a second distance such that the friction cam comes into contact with the surface attached to the base of the polishing system intermittently.

12. A method of polishing an end of an optical fiber for use in fiber optical systems, comprising:

mounting a polishing disk on a polisher;

applying a polishing substance on the polishing disk;

inserting the optical fiber in a holding assembly;

applying a predefined pressure on the end of the optical fiber in contact with the polishing disk;

actuating a drive connected to the polishing disk at a preselected rate of rotation; and rotating the polishing disk having a cam mechanism such that relative motion between the polishing disk and the end of the optical fiber is neither circular nor orbital.

13. The method of claim 12, wherein the rate of rotation, the polishing substance and the predefined pressure are selected such that a step of polishing is completed in less than one minute and the end of the optical fiber is final polished by removing any epoxy, rough polishing and final polishing in a continuous process without replacing the polishing disk or changing the predefined pressure.

14. The method of claim 13, wherein the step of polishing is completed in no greater than 45 seconds.

15. The method of claim 12, further comprising: selecting an optical fiber having a fiber end radius and apex offset nominally operative for a desired application, wherein the pressure and rate of rotation are selected such that the fiber end radius and apex offset do not substantially change during the step of polishing.

16. The method of claim 15, wherein no step of buffing is needed after the step of polishing and prior to use of the optical fiber in the desired application.

17. The method of claim 15, wherein the step of applying a predefined pressure selects a pressure of about 0.4 pounds or less than 0.4 pounds.

18. The method of claim 17, wherein the pressure of about 0.4 pounds may be used for an optical fiber, using a 1 micron diamond film as the polishing film on the polishing disk.

19. The method of claim 12, further comprising a step of buffing the end of the optical fiber using a buffing medium comprising silicon dioxide.

* * * * *